United States Patent [19]

McCoy

[11] Patent Number: 5,005,798

[45] Date of Patent: Apr. 9, 1991

[54] TROLLING MOTOR MOUNT

[76] Inventor: Thomas C. McCoy, 2796 W. Country Club Rd., Searcy, Ark. 72143

[21] Appl. No.: 591,934

[22] Filed: Oct. 2, 1990

[51] Int. Cl.[5] ..... B63H 5/00

[52] U.S. Cl. ..... 248/642; 248/231.7; 248/284

[58] Field of Search ..... 248/642, 640, 641, 643, 248/284, 540, 231.7; 440/55, 56, 900

[56] References Cited

U.S. PATENT DOCUMENTS

| | | | |
|---|---|---|---|
| 1,789,509 | 1/1931 | Bergstrom | 248/540 X |
| 2,950,888 | 8/1960 | Cottrill et al. | 248/540 |
| 3,119,365 | 1/1964 | Evans | 248/642 X |
| 3,578,277 | 5/1971 | Osborn | 248/642 |
| 3,604,674 | 9/1971 | Wilkerson | 440/55 X |
| 3,765,632 | 10/1973 | Riggs | 248/231.7 |
| 4,019,703 | 4/1977 | Meredith et al. | 248/642 |
| 4,094,482 | 6/1978 | Weaver | 248/642 |
| 4,432,527 | 2/1984 | Sample | 248/642 X |
| 4,734,068 | 7/1986 | Edwards | 440/56 |

*Primary Examiner*—Karen J. Chotkowski

*Attorney, Agent, or Firm*—Stephen D. Carver

[57] ABSTRACT

A mount for dynamically attaching an auxiliary trolling motor at a user-selective position over the gunwale, transom, or stern of a fishing boat. The mount comprises a rigid bracket secured by a screw-clamp to the wall of the boat. The bracket comprises a pair of sides spaced apart by a planar top. A bottom projects inwardly toward the open interior of the bracket. An adjustable base associated with the bracket bottom provides width-compensation to accommodate different mounting surfaces. A rigid shelf projects engages the gunwale or side molding of the boat to prevent undesired movement during operation. A rigid block rotatably mounts the trolling motor to the bracket. A first hinge extends along the length of the bracket to define a first axis of rotation. A second hinge extends perpendicular to the first hinge to define a second axis of rotation. Rotation of the block about the first and second axes moves the motor between a deployed position and storage position. A rigid travel-limiting stop cooperates with a rigid locking tab to prevent undesired rotation of the motor during operation.

16 Claims, 3 Drawing Sheets

TROLLING MOTOR MOUNT

BACKGROUND OF THE INVENTION

My invention relates generally to devices for mounting motors to boats. More specifically, the present invention relates to a device for dynamically mounting an auxiliary trolling motor to a desired portion of fishing boat, such as the side. The device facilitates convenient deployment and storage at various desired positions on the boat. The present mount also resiliently responds to protect the motor from damage by impact with an underwater obstruction.

Electric trolling motors are typically used on fishing boats for maneuvering slowly and quietly through a target fishing area, in order to avoid frightening away the fish. In flat-bottom fishing boats or similar small watercraft, such motors are generally mounted on the stern of the boat opposite the transom near the thwart or fisherman's seat. Based on my experimentation, such front mounting often creates difficulty and discomfort for the fisherman, since he must reach around or over his seat to steer or control the trolling motor. It is thus desired to provide a trolling motor mounting bracket which may be selectively disposed in any of a variety of user selectable positions on the boat. Often, for example, it is more comfortable to side mount the motor in an accessible position adjacent the seat.

Trolling motors are commonly provided with a mounting device, such as a pair of conventional C-clamps or the like. Such clamps are adapted to fit over the stern or transom of a boat with their screws subsequently tightened against the interior wall of the stern. However, such clamps are difficult to properly mount over the gunwale on the side of a fishing boat, since the gunwale typically projects outwardly several inches from the side of the boat, and the trolling motor ends up in an improperly slanted orientation. Thus use of conventional clamps does not permit the fisherman to position the trolling motor anywhere he wants on the side of the boat.

Additionally, typical trolling motor mounting devices provide only for limited tilting of the motor between an upright, deployed position and an inclined storage position. Although the trolling motor can be lifted up out of the water, if it is desired to dispose the trolling motor within the boat during transport or while the primary motor is engaged, the fisherman must generally unfasten the mounting clamp. Instead of exerting the additional effort required to remount the motor before each use, the fisherman will typically leave the trolling motor attached and transport the boat with the motor in the inclined position In this position, the motor may cause injury or be itself damaged during travel, trailering, or transport. Thus it is desirable to provide a trolling motor mounting bracket which permits the motor to be temporarily stored safely inside the boat when desired.

Finally, because trolling motors are typically operated at lower speeds, generally no provision is made for allowing the motor to deflect out of the path of an underwater obstruction. However, based on my experience, the lightweight shaft and rotor of the trolling motor are easily damaged by even small underwater objects. Therefore, it would seem necessary to provide some means for allowing the motor to resiliently respond to underwater obstructions.

In the prior art known to me, various devices have been proposed for mounting trolling motors. For example, Evans, U.S. Pat. No. 3,119,365, issued Jan. 28, 1964, provides a trolling motor mounting bracket which may be selectively rotated between a first and second position. In the first, deployed position, the motor bracket extends over the gunwale of a boat, and in the second position, the motor is retracted and stored upon the boat thwart or on the floor of the boat.

There are numerous disadvantages associated with known prior art devices. For example, when typical brackets are manipulated to dispose the trolling motor in a storage position, the motor occupies and clutters too much interior space. With the motor stored on the floor, the shaft and rotor project upwardly in the interior of the boat. The exposed rotor blade could inflict serious injury to a fisherman if the boat jolted or tipped during travel In a situation where other fishermen are in the boat with the operator, the storage of the motor would create substantial inconvenience. Finally, most brackets provide no means for allowing the motor to resiliently respond to impacts with underwater objects.

U.S. Pat. No. 3,424,412 issued to Gayle on Jan. 8, 1969 discloses an outboard motor mount comprising a generally C-shaped clamp which is fastened to the transom of the boat. The trolling motor is twistably secured through the outer bracket, and the bracket itself can be moved up and over the side of the boat to store the motor in a horizontal position.

Weaver Patent No. 4,076,193, issued Feb. 28, 1978 teaches a device comprising a clamping member adapted to be secured through the threaded member to the transom of the boat. The clamp comprises a metallic bar which pivotally secures the shank of the trolling motor. By manipulating the bar, the motor may be pivoted into the rear interior of the boat. U.S. Pat. No. 4,019,703, issued to Meredity on Apr. 26, 1977 discloses a basic mount which may be attached either to the transom or the side of the boat. The standard fastening clamp of the motor is attached to a pivotal block, which tilts the upper end of the motor into the boat.

However, none of the foregoing motor-mounting brackets known to me facilitate side mounting anywhere along the boat. None permits convenient temporary storage of the auxiliary motor in a safe manner which does not interfere with comfortable use of the boat, while also affording protection of the motor-mounting shaft.

SUMMARY OF THE INVENTION

The present invention is a trolling motor mounting fixture adapted to fit over the gunwale on the side of a fishing boat. My mount facilitates maximum maneuverability of the trolling motor for user safety and comfort, and it is dynamically adjustable to enable deployment of the trolling motor in a variety of positions.

The mount comprises a rigid bracket having an open interior defined between a pair of rigid spaced-apart sides and a generally planar top. The inner side of the bracket comprises a mounting orifice for receiving a conventional screw-driven clamp which tightens against the interior wall of the boat. The outer side of the bracket terminates in an integral bottom which projects inwardly into the open bracket interior. A rigid base is adjustably coupled to the bottom. The base may be selectively positioned relative to the bracket to provide width-compensation so that the bracket may be fit upon various parts of the boat such as over the side or upon the transom. A rigid shelf projects inwardly within the bracket interior to firmly engage the gunwale or side molding of the boat, so that undesired side to side rocking is prevented.

A rigid rotatable block mounts the trolling motor to the bracket. The trolling motor mount is clamped to the block. A pair of hinges project at a right angle from a common origin on the top of the bracket. A first hinge extends along the length of the bracket top and defines a first axis of rotation. The second hinge extends perpendicular to the first hinge to define a second axis of rotation for the motor block. By manipulation of the block about these predefined axes, the motor may be conveniently moved between a position first, deployed position and a second, storage position.

Rotation about the first axis results in "horizontal" movement of the motor to and from the exterior from and to the interior of the boat. Rotation about the second axis results in "vertical" movement of the motor between a fully vertical position and a horizontal storage position. This vertical rotation allows the motor to deflect upwardly out of the path of underwater obstructions, so that damage to the motor shaft and propeller are avoided. A rigid stop cooperates with a rigid locking tab to limit travel of the block in various directions relative to the bracket.

Thus it is a broad object of the present invention to provide a trolling motor mount for use on small watercraft, which enables the trolling motor to be mounted in a variety of positions on the boat.

A similar broad object of the present invention is to provide a device for mounting a trolling motor at various user-selective positions on the side of a fishing boat.

A further broad object of the present invention is to provide a mount for a trolling motor which dynamically responds to impacts with underwater objects.

Another object of the present invention is to provide a trolling motor mount of the character described which may be securely clamped over the gunwale of a fishing boat.

Yet another object of the present invention is to provide a trolling motor mount which facilitates alternative deployment and storage of the trolling motor.

An additional object of the present invention is to provide a trolling motor mount capable of receiving various types of motors.

A further object of the present invention is to provide a trolling motor mount of the character described which may be conveniently positioned anywhere on a boat within the fisherman's reach.

A further object of the present invention is to provide a motor mount which pivots to raise the motor shaft out of the path of an underwater obstruction.

A related object is to provide a trolling motor mount of the character described which permits the motor to be conveniently stored without occupying needed space in the boat interior.

Still another object is to provide a trolling motor mount of the character described which facilitates both horizontal and vertical rotation of the motor for convenience of the user.

An additional object is to provide a trolling motor mount of the character described which may be selectively locked against rotation when the motor is operated in reverse.

These and other objects and advantages of the present invention, along with features of novelty appurtenant thereto, will appear or become apparent in the course of the following descriptive sections.

In the following drawings, which form a part of the specification and which are to be construed in conjunction therewith, and in which like reference numerals have been employed throughout wherever possible to indicate like parts in the various views.

DETAILED DESCRIPTION

Figure 1:
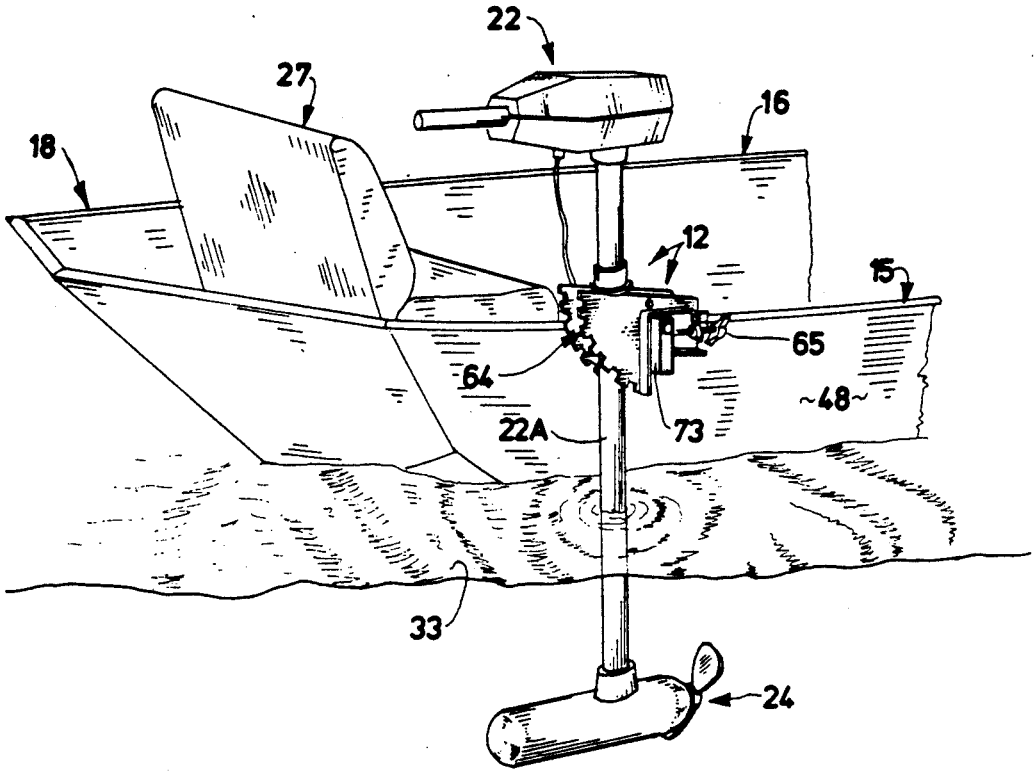
FIG. 1 is a pictorial view showing the best mode of my new TROLLING MOTOR MOUNT in use, illustrating the trolling motor in a deployed position.
Figure 2:
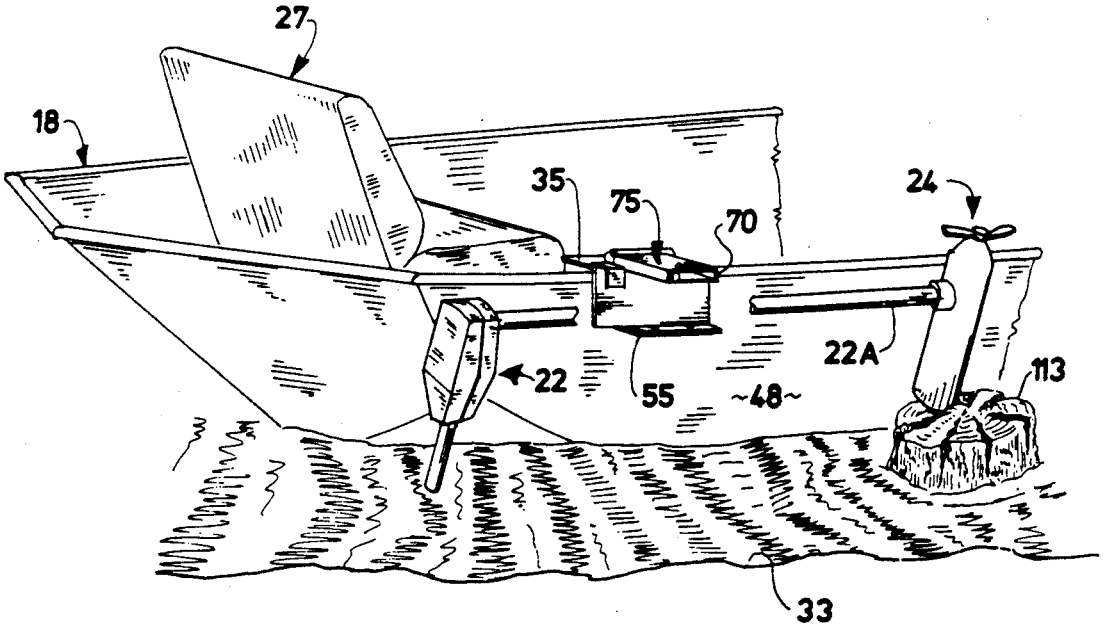
FIG. 2 is a fragmentary pictorial view, illustrating deflection of the mount in response to impact with an obstruction.
Figure 6:
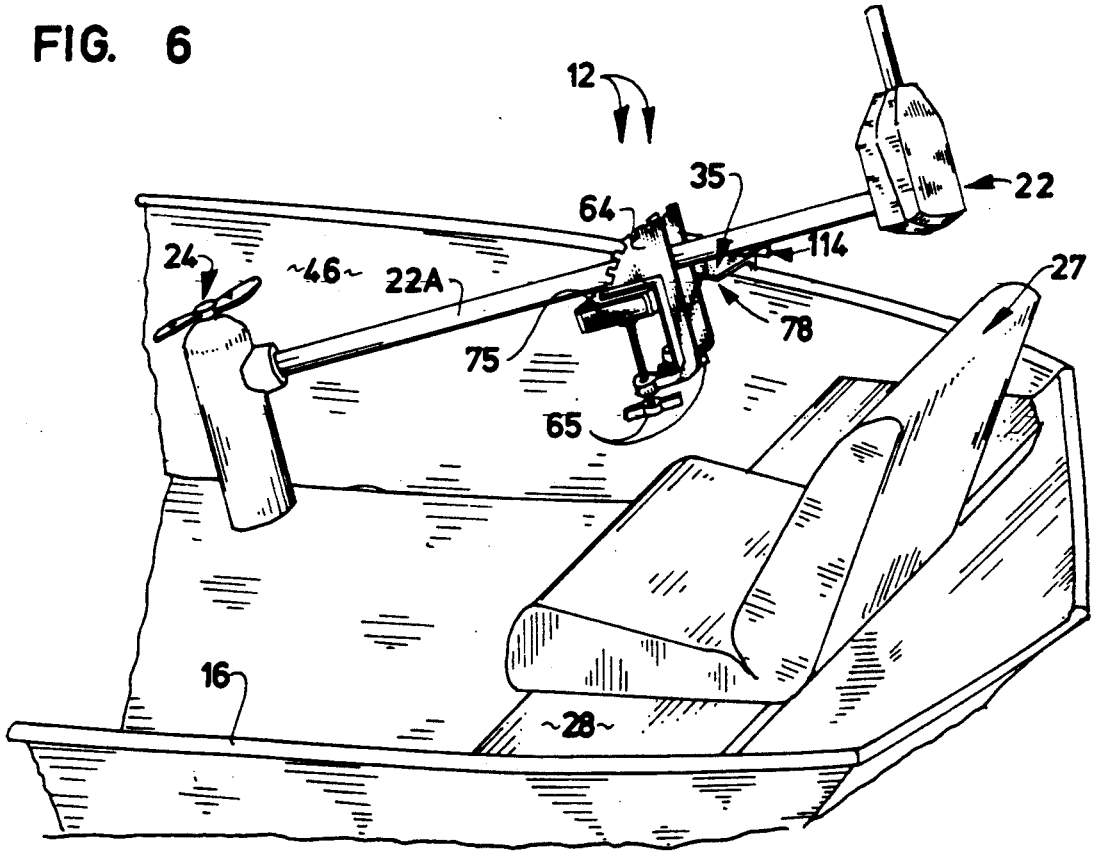

With initial reference directed to FIGS. 1, 2, and 6 of the appended drawings, my new trolling motor mount, broadly designated by the reference numeral 12, is adapted to fit over the gunwale 15 and/or side 16 of a small watercraft such as a fishing boat 18. A conventional electric trolling motor 22 may be comfortably positioned adjacent the fisherman's seat 27 or ledge 28 (FIG. 6) for convenient maneuvering by a fisherman. The mount 12 permits a wide range of horizontal and vertical rotation of the trolling motor 22 relative to the boat 18 for convenient storage and deployment. In the fully deployed position shown in FIG. 1, motor shaft 22A extends alongside the boat to project the propeller unit 24 into the water 33. In the storage position (FIG. 6), motor 22 is oriented generally horizontally adjacent the side of the boat, so as to occupy a minimal amount of space.

Figure 3:
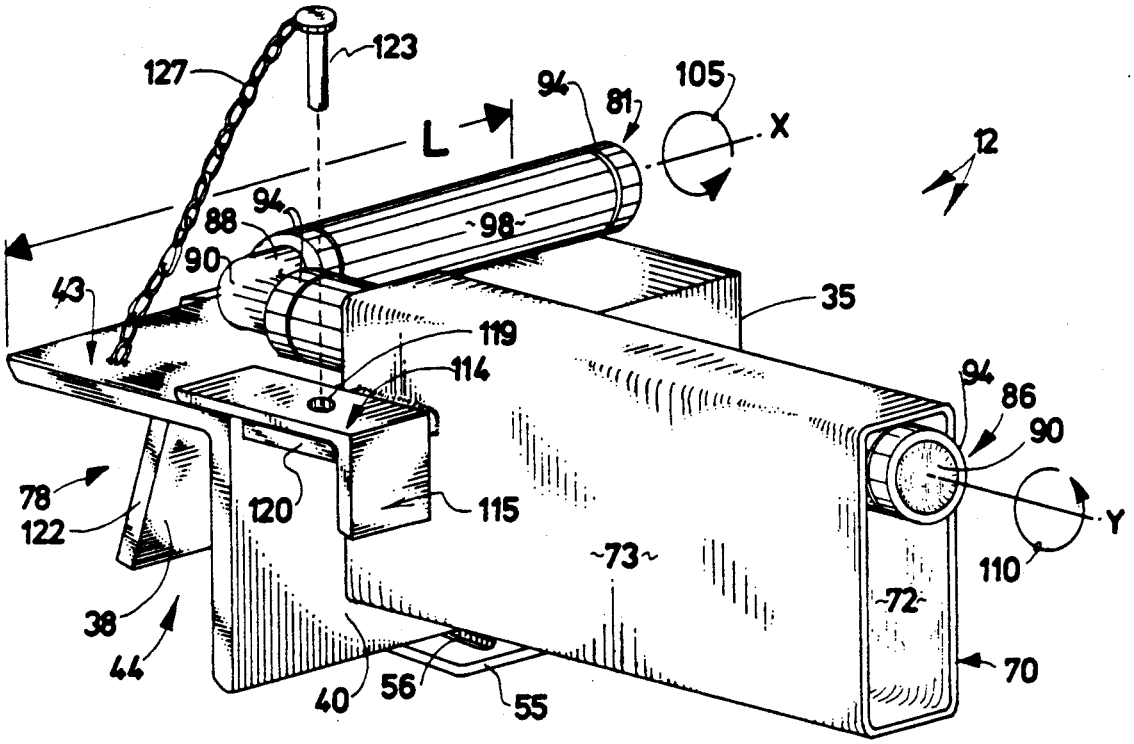
FIG. 3 is an enlarged scale, fragmentary, isometric view of the mount.
Figure 4:
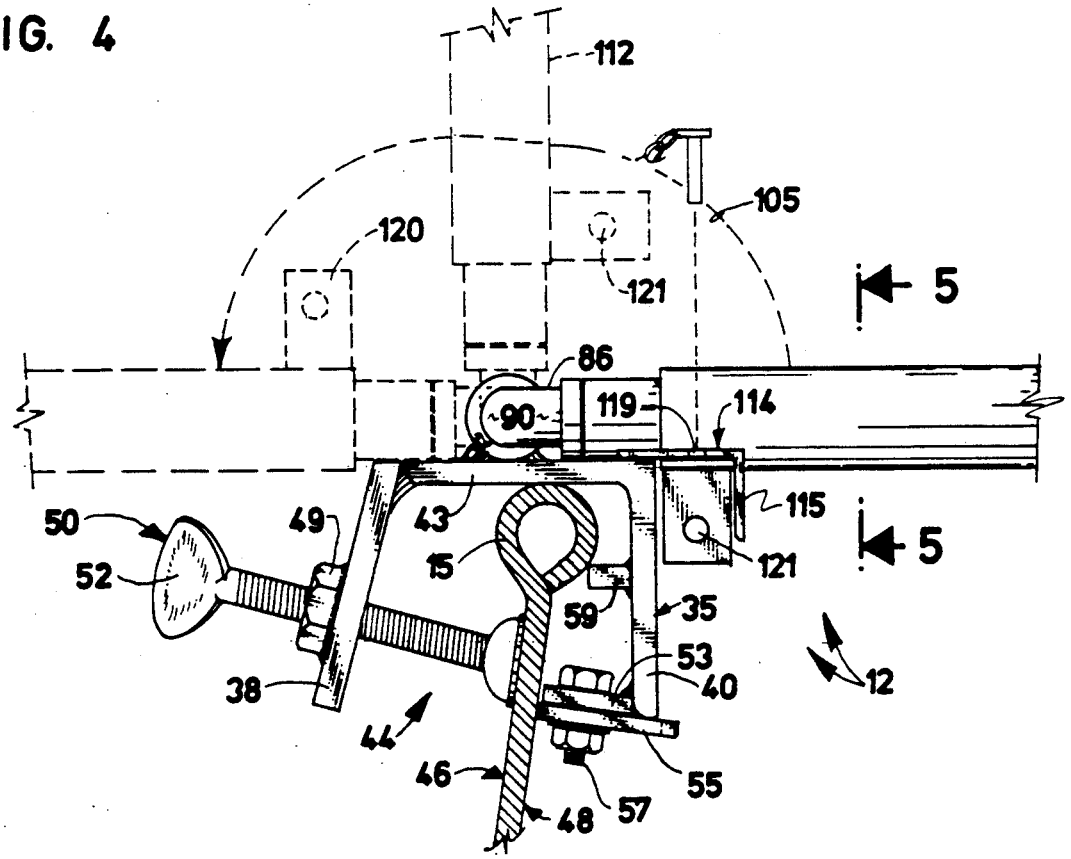
FIG. 4 is a fragmentary, front elevational view thereof, in which various alternative orientations are illustrated in broken lines.

With additional reference directed to FIGS. 3 and 4, mount 12 comprises a rigid, generally U-shaped bracket 35 adapted to be forcibly secured to the boat. Bracket 35 comprises a pair of rigid spaced-apart sides 38, 40 which extend downwardly from opposite sides of an integral, generally planar top 43. Sides 38, 40 and top 43 define an open interior 44. When mount 12 is properly installed, bracket 35 rests upon or above gunwale 15 (FIG. 4), bracket side 38 projects downwardly from top 43 adjacent the interior wall 46 of boat side 16 (FIG. 6), and bracket side 40 projects downwardly from top 43 along the exterior wall 48 of boat side 16 (FIGS. 1 and 2). Side 38 preferably comprises a mounting receptacle 49 penetrated by a conventional screw-driven clamp 50 (FIG. 4). Clamp 50 preferably comprises a handle 52 which may be conveniently manipulated to tighten the clamp to the boat. Bracket side 40 terminates in an integral, inwardly projecting bottom 53 (FIG. 4).

Bottom 53 comprises manually adjustable means for accommodating boats of different sizes or for allowing selective angular disposition of the trolling motor 22 relative to the boat. With reference to FIGS. 3 and 4, bracket bottom 53 mounts a rigid, planar base member 55. Base member 55 comprises one or more elongated follower slots 56 which are penetrated by conventional nut and bolt assemblies 57 extending downwardly from bottom 53. Slots 56 permit slidable adjustment of base member 55 relative to bottom 53 to compensate for the width of the stern, transom, or gunwale of the boat or other mounting surface.

When the bracket 35 is initially installed, bolts 57 are loosened so that the base member 55 slides outwardly away from interior 44 of bracket 35. Once the bracket is properly positioned over the gunwale or upon the boat transom, base member 55 may be slid inwardly into firm abutment with the boat wall and the bolts 57 tightened, so as to clamp the bracket 35 solidly in place.

Additional securing means are provided in the form of a rigid shelf 59 which projects integrally from side 40 inwardly toward the exterior wall 48 (FIG. 4). When the bracket 35 is positioned over the gunwale, shelf 59 projects beneath the gunwale (FIGS. 4). On fishing boats equipped with a side molding, shelf 59 may slide beneath the side molding to secure the bracket, so that bracket 35 is held firmly in position.

As best viewed in FIGS. 1, 2, 5, and 6, the trolling motor 22 is coupled to mount 12 by fastening the motor support 64, typically comprising a pair of clamps 65, to the rigid mounting block 70. Block 70 comprises a hollowed interior 72, a front face 73, and a rear face 75. Block 70 provides a smooth surface to which the motor support may be securely clamped. The motor shaft 22A preferably rests against front face 73, and the motor clamps 65 may be tightened against rear face 75.

If the motor clamps 65 are properly tightened, the fisherman may reposition or remove the mount 12 and motor 22 as a unit without first removing the motor from the block 70. When it is desired to reposition the motor for more convenient access, bracket clamp 58 may be unscrewed to release bracket 35, so that the mount 12 and motor 22 may be conveniently lifted off the gunwale and remounted at the desired position.

Bracket top 43 defines a length L, which extends generally parallel above gunwale 15 when the mount is positioned on the side 16 of the boat 18. The inner bracket side 38 extends roughly two-thirds the length L of top 43 to define a gap 78. Outer side 40 extends the full length of top 43. Length L provides a convenient reference point for discussion of the horizontal and vertical rotation of the mount and trolling motor. Block 70 is dynamically coupled to bracket 35 by a pair of hinges 81, 86.

The first hinge 81 is permanently mounted to bracket top 43 along length L, and defines a first axis of rotation X for block 70, which is parallel to length L. The second hinge 86 is permanently mounted to block 70, preferably penetrating the hollow interior 72. The second hinge 86 defines a second axis of rotation Y for block 70, which is roughly perpendicular to length L and first axis of rotation X.

As best viewed in FIG. 3, hinges 81, 86 comprise a pair of elongated, rigid mandrels 88, 90 mounted by means of a weld or the like to top 43 at right angles. Mandrels 88, 90 terminate in enlarged diameter ends 94 which capture elongated, tubular sleeves 98, 101. The sleeve 98 of first hinge 81 is welded to top 43 of the mount bracket 35, and therefore provides a stationary housing within which mandrel 88 rotates. First hinge 81 defines a first arc of rotation 105 for mount 12, which defines a plane perpendicular to length L and the first axis of rotation X (FIG. 4). Preferably arc 105 comprises roughly one hundred eighty degrees, which allows the motor to be pivoted horizontally between the outside of the boat as viewed in FIGS. 1 and 2 and the inside of the boat, as seen in FIG. 6.

In the first position, the motor extends outside the boat generally parallel to exterior wall 48 of boat. In the storage position, the motor is positioned inside the boat, adjacent interior wall 46. This horizontal rotation along arc 105 facilitates convenient storage of the motor without requiring removal of the bracket from the boat. Inward rotation of block 70 along arc 105 is limited to one hundred eighty degrees, since hinge 86 contacts top 43 adjacent the bracket interior side 38.

Figure 5:
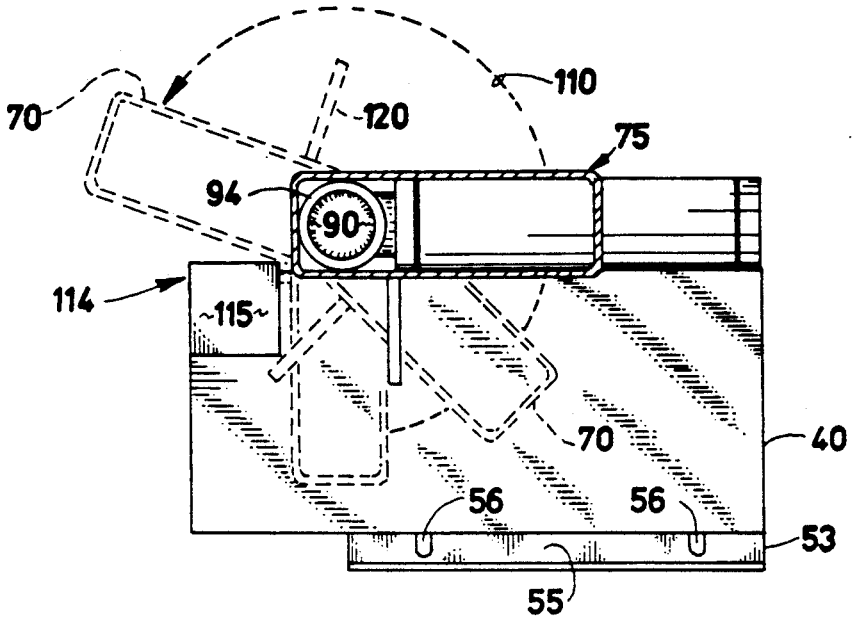
FIG. 5 is a fragmentary, sectional view taken generally along line 5—5 of FIG. 4; and, FIG. 6 is a fragmentary pictorial view, illustrating the trolling motor disposed in a storage position.

With reference to FIGS. 3 and 5, the second hinge 86 projects outwardly from top 43 perpendicular to first hinge 81. Sleeve 101 of the second hinge 86 is journaled for rotation about mandrel 90, which remains stationary. The hinge 86 projects through the hollow interior 72 of block 70, which is permanently secured by means of a weld to sleeve 101. Hinge 86 pivots about a second arc 110, which defines a plane generally parallel to the first axis of rotation X, and perpendicular to first arc 105.

Preferably block 70 pivots at least ninety degrees on hinge 86, in order to allow the motor 22 to be moved between a vertical position, in which the motor shaft 22A extends into the water (FIG. 1), and a generally horizontal position, which is assumed for storage (FIG. 6). In the best mode, arc 110 comprises roughly two hundred twenty-five degrees, which permits maximum maneuverability (FIG. 5). For example, when it is desired to store the motor inside the boat, the fisherman may first pivot the motor shaft 22A about arc 110 upwardly to a fully horizontal position, rotate the block 70 and motor 22 about arc 105 to an intermediate position 112 (FIG. 4) into the boat, and then tilt the motor shaft further about arc 110, so that the propeller 24 projects downwardly, safely out of the way of occupants of the boat. Thus injury and damage from inadvertent contact with the propeller is prevented.

Importantly, rotation of the motor shaft along arc 110 permits the motor to resiliently deflect out of the path of obstacles upon or under the water. As best viewed in FIG. 2, when the motor shaft 22A strikes a partially submerged tree limb or stump 113, block 70 will deflect, lifting the motor shaft 22A and propeller 24 up over the stump and out of the water 33. When the stump 113 is cleared or the obstruction removed, the motor shaft 22A will pivot block 70 back to its vertical position, lowering the motor shaft 22A and propeller 24 safely into the water. Thus damage to the propeller 24 and motor shaft 22A are avoided, and fishing may continue generally uninterrupted.

As will be appreciated, it is desirable to limit forward rotation of the trolling motor 22 relative to bracket 35 in order to facilitate proper forward propulsion and control of the boat. Thus, travel-limiting means are provided to limit rotation of block 70 along arcs 105, 110 when the motor is deployed for use.

17 With reference directed to FIGS. 3–5, a rigid, generally L-shaped stop 114 projects integrally outwardly from bracket top 43 toward block 70. The outer, downwardly projecting end 115 of stop 114 projects downwardly generally parallel to bracket side 40 to define a channel 117. Stop 114 limits forward rotation of block 70 about second axis of rotation Y beyond the limits of second arc 115.

A rigid, planar locking tab 120 projects outwardly from block 70 toward stop 114. Tab 120 is configured to fit within channel 117 and thus lock block 70 against upward rotation about first axis of rotation X and along first arc 105 when the motor is positioned in its fully vertical, deployed orientation. The locking tab 120 prevents upward deflection of the block when the motor is positioned for forward propulsion. An orifice 119 in stop 114 (FIGS. 3 and 4) may align with orifice 121 in tab 120 when block 70 is disposed as in FIG. 3 (the normal tolling position). At this time pin 123, which is loosely coupled to the device by retainer chain 127, may be inserted through aligned orifices 119, 121 to lock the mount.

When block 70 pivots to deflect motor shaft 22A out of the way of an obstruction, locking tab 120 is deflected out of engagement with channel 117 (FIG. 4), so that block 70 may rotate upwardly about first axis X and lift the motor out of harm's way. When it is desired to store the trolling motor 22 in the boat, the fisherman must first rotate the motor shaft 22A upwardly along arc 110 roughly forty-five degrees (FIG. 5) to disengage tab 120 from channel 117 and clear stop 114. Subsequent rotation of the motor inwardly along first arc 105 positions the motor 22 horizontally within the boat along interior wall 46. The motor 22 may then be rotated forwardly about arc 110. Forward rotation is limited as the rigid tab 120 contacts the front edge 122 of inner bracket side 38 at gap 78 (FIG. 3).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A trolling motor mount for a fishing boat, said mount comprising:

rigid bracket means for coupling said mount to said boat, said bracket means having a predetermined length and comprising a pair of rigid spaced-apart sides;

clamp means for at least temporarily securing said bracket means to said boat;

block means adapted to receive said trolling motor for coupling said motor to said mount;

first hinge means defining a first axis of rotation parallel with said length for rotatably mounting said block means to said bracket means such that said block means and said motor may be rotated in a first arc defining a plane generally perpendicular to said first axis of rotation, whereby said motor moves between a deployed position and a storage position; and, second hinge means defining a second axis of rotation generally perpendicular to said first axis of rotation for rotatably mounting said block means to said bracket means such that said block means and said motor may be rotated in a second arc defining a plane generally parallel to said first axis of rotation, whereby to permit said trolling motor to deflect in response to impact with underwater obstacles.

2. The trolling motor mount as defined in claim 1 wherein said rigid bracket means comprises rigid, adjustable base means slidably associated with said bracket means for contacting the gunwale or side of said boat, said base means projecting inwardly from one of said pair of bracket sides.

3. The trolling motor mount as defined in claim 2 comprising adjustable width-compensation means for conforming said bracket means to properly fit to the side, transom, or gunwale of said boat.

4. The trolling motor mount as defined in claim 3 wherein said bracket means comprises stop means projecting outwardly from said bracket means for limiting rotation of said block means about said second axis of rotation.

5. The trolling motor mount as defined in claim 4 wherein said block means comprises lock means for contacting said stop means for preventing rotation of said block means about said first axis of rotation.

6. The trolling motor mount as defined in claim 5 wherein said stop means is generally L-shaped and projects outwardly integrally from said bracket means.

7. The trolling motor mount as defined in claim 6 wherein said lock means fits within said stop means.

8. The trolling motor mount as defined in claim 7 comprising shelf means integral with said bracket means for engaging the side or gunwale of said boat.

9. The trolling motor mount as defined in claim 8 wherein said first arc defined by rotation of said block means over said bracket means is one hundred eighty degrees, and wherein said second arc defined by rotation of said block means is at least ninety degrees.

10. A mounting device for coupling a trolling motor to a fishing boat, said device comprising:

rigid bracket means for coupling said mount to said boat, said bracket means having a length and comprising a pair of rigid spaced-apart sides, a bottom, and a rigid top connecting said pair of sides;

rigid, adjustable base means slidably coupled to said bottom of said bracket means for contacting the gunwale or side of said boat, said base means projecting inwardly from one of said pair of bracket sides to conform said bracket means to properly fit said boat;

block means for coupling said motor to said mount;

first hinge means defining a first axis of rotation parallel with said length for rotatably mounting said block means to said bracket means such that said block means may be rotated in a first arc generally perpendicular to said first axis of rotation, whereby said trolling motor moves between a deployed position and a storage position;

second hinge means defining a second axis of rotation generally perpendicular to said length for rotatably mounting said block means to said bracket means such that said block means may be rotated in a second arc generally parallel to said first axis of rotation, whereby to permit said trolling motor to deflect upwardly in response to impact with underwater obstacles;

stop means for limiting rotation of said block means about said second axis of rotation; and, lock means for contacting said stop means for preventing rotation of said block means about said first axis of rotation.

11. The trolling motor mounting device as defined in claim 10 wherein said stop means is generally L-shaped and integrally outwardly from said mounting device, and said lock means fits within said stop means.

12. The trolling motor mounting device as defined in claim 11 wherein fitting of said lock means within said stop means occurs only when said trolling motor is positioned generally vertically in said deployed position.

13. The trolling motor mounting device as defined in claim 12 wherein said bracket means comprises rigid, integral shelf means for securing said bracket about said gunwale.

14. The trolling motor mounting device as defined in claim 13 wherein said bracket means comprises adjustable clamp means for at least temporarily securing said bracket means to said boat.

15. The trolling motor mounting device as defined in claim 14 wherein one of said pair of bracket means sides is roughly one-half the length of said bracket means, whereby to facilitate mounting and adjustment of said bracket means.

16. A mount for dynamically coupling a trolling motor to a fishing boat, said mount comprising:

a rigid, generally L-shaped bracket, said bracket comprising rigid spaced-apart sides, a bottom, a rigid top connecting said sides, and a length defined centrally between said sides;

a rigid, adjustable base slidably coupled to said bracket bottom, said base projecting inwardly from one of said sides to facilitate adjustment of said bracket to properly fit about the gunwale of said boat;

a rigid shelf projecting integrally inwardly from one of said bracket sides to securely engage said the side or gunwale of said boat;

a rigid, adjustable screw clamp for at least temporarily securing said bracket to said boat;

a rigid, elongated motor mounting block;

a first hinge defining a first axis of rotation parallel to said length, whereby said block may be rotated over said bracket along a first arc of roughly one hundred eighty degrees to move said trolling motor between a generally vertical, deployed position and a generally horizontal, storage position;

a second hinge defining a second axis of rotation generally perpendicular to said length, whereby said block and said motor may be rotated along a second arc generally parallel to said first axis of rotation of roughly two hundred twenty-five degrees whereby to permit said motor to resiliently deflect upwardly in response to impact with underwater obstacles;

a rigid, generally L-shaped stop integral with said bracket for limiting rotation of said block about said second axis of rotation; and, a rigid lock projecting integrally outwardly from said block to fit within said stop whereby said lock prevents rotation of said block about said first axis of rotation.

* * * * *